US008390435B2

(12) United States Patent
Maros et al.

(10) Patent No.: US 8,390,435 B2
(45) Date of Patent: Mar. 5, 2013

(54) APPARATUS FOR CONTROLLING INTEGRATED LIGHTING BALLASTS IN A SERIES SCHEME

(75) Inventors: István Maros, Budapest (HU); Sándor Viktor Szabó, Budapest (HU)

(73) Assignee: General Electric Company, Schenectady, NY (US)

( * ) Notice: Subject to any disclaimer, the term of this patent is extended or adjusted under 35 U.S.C. 154(b) by 840 days.

(21) Appl. No.: 12/537,476

(22) Filed: Aug. 7, 2009

(65) Prior Publication Data

US 2011/0032085 A1 Feb. 10, 2011

(51) Int. Cl.

| | |
|---|---|
| ***G08C 19/16*** | (2006.01) |
| ***G08C 19/12*** | (2006.01) |
| ***G08B 1/08*** | (2006.01) |
| ***G09F 25/00*** | (2006.01) |
| ***G05F 1/00*** | (2006.01) |

(52) U.S. Cl. ..... 340/12.32; 340/12.35; 340/13.23; 340/538.13; 340/538.15; 340/286.01; 315/294

(58) Field of Classification Search ..... None
See application file for complete search history.

(56) References Cited

U.S. PATENT DOCUMENTS

| | | | | | |
|---|---|---|---|---|---|
| 4,348,582 | A * | 9/1982 | Budek | 219/483 |
| 4,408,185 | A * | 10/1983 | Rasmussen | 307/3 |
| 5,066,939 | A * | 11/1991 | Mansfield, Jr. | 455/402 |
| 5,212,478 | A * | 5/1993 | Moseley | 340/4.3 |
| 5,264,823 | A | 11/1993 | Stevens | |
| 5,475,360 | A * | 12/1995 | Guidette et al. | 340/12.32 |
| 5,691,691 | A | 11/1997 | Merwin et al. | |
| 6,441,723 | B1 | 8/2002 | Mansfield, Jr. et al. | |
| 6,822,555 | B2 | 11/2004 | Mansfield, Jr. et al. | |
| 7,456,588 | B2 * | 11/2008 | Alexandrov | 315/294 |
| 2004/0164688 | A1 * | 8/2004 | Van Tichelen et al. | 315/292 |
| 2009/0091429 | A1 * | 4/2009 | Myoung et al. | 340/310.11 |

* cited by examiner

*Primary Examiner* — George Bugg
*Assistant Examiner* — Renee Dorsey
(74) *Attorney, Agent, or Firm* — Fay Sharpe LLP

(57) ABSTRACT

Power line communication (PLC) systems are presented for connecting dimming switches with electronic ballasts for driving compact fluorescent lamps and other applications using a power distribution network, including a transmitter and a receiver connected in a series circuit for transmission of multi-bit data, where the receiver has a load control circuit for selectively adjusting the receiver loading and to sense current interruptions to provide a data output.

16 Claims, 5 Drawing Sheets

APPARATUS FOR CONTROLLING INTEGRATED LIGHTING BALLASTS IN A SERIES SCHEME

BACKGROUND OF THE DISCLOSURE

Ballasts and other lamp drivers can be used in conjunction with dimming switches to selectively dim the light output of a lamp according to user settings. In many preexisting lighting systems, dimmer controlled incandescent bulbs are being replaced by fluorescent lamps in order to achieve energy savings and/or for regulatory compliance. Ballast systems provide electrical power to compact fluorescent lamps and other fluorescent lamps. Dimming ballasts are particularly popular, providing intelligent dimming features and other advanced lighting functionality not achievable with normal incandescent bulbs controlled by wall switches or dimmers. However, the dimming controls and power distribution wiring for legacy incandescent bulbs typically do not allow direct replacement of the light fixture and wall controls. Power Line Communications (PLC) systems provide intelligent communications between wall control units and lighting fixtures, but no simple solution exists for upgrading most legacy systems with PLC-based lighting controls. The DALI bus, for example, requires installation of new wiring, and existing PLC schemes generally (e.g., such as X10) are often expensive, unreliable, do not tolerate many devices installed in close proximity, and cannot be directly connected in place of existing switches and dimmers. Furthermore, the use of existing phase-angle controllers often leads to an unreliable installation (flickering) and requires sophisticated electronics in the ballast.

SUMMARY OF THE DISCLOSURE

A power line communication (PLC) system with a transmitter and receiver connected in series via a power distribution network, in which the transmitter has a switch controlled to selectively interrupt the current for relaying data to the receiver based on one or more user input signals or values, such as lamp dimming levels. The receiver is coupled in series with the transmitter via the power distribution network, and includes a rectifier and a driver circuit to selectively power a compact fluorescent lamp (CFL) or other lighting device, as well as a load control circuit operable by a receiver controller to selectively apply an auxiliary load to a load side of the rectifier. The load control circuit also operates as a data receiver which senses the transmitter-generated current interruptions and provides a data output to the controller. The receiver in some implementations includes a filter circuit with an inductance and a capacitance coupled between the receiver terminals and the rectifier. In certain embodiments, the transmitter sends multi-bit data to the transmitter via the power distribution network, and may include zero-crossing detection components to sense a zero crossing of AC current flowing in the power distribution network, and the data transmission is controlled to transmit the multi-bit data by selectively interrupting current flow at a time when the voltage of the AC power is almost zero. The use of several bits of information on each zero-crossing of the AC waveform advantageously increases data throughput, and the transmitter may use digital modulation with redundancy codes and/or error correcting codes to further increase reliability even in case of interference. The transmitter is self-powered in some embodiments, moreover, including a power supply circuit to receive power from the current sensor circuit and to supply power to the transmitter. In some embodiments, the transmitter switch circuit is a normally closed TRIAC circuit including a TRIAC. The series connection of the transmitter and receiver facilitates installation of the transmitter in place of a legacy switch to control the same appliances as were previously controlled by the switch, and the system mitigates or overcomes problems related to interference with similar devices in close proximity. The transmitter, moreover, can transmit periodically, thereby making the data communication fault-tolerant, and the use of a TRIAC or other semiconductor-based switching circuit in certain embodiments allows the transmitter to implement phase angle type dimming control if needed. The provision in the receiver of an auxiliary load circuit advantageously facilitates use of the PLC system with ballast driver circuits that do not provide power factor correction (PFC).

BRIEF DESCRIPTION OF THE DRAWINGS

One or more exemplary embodiments are set forth in the following detailed description and the drawings, in which.

DETAILED DESCRIPTION OF THE PREFERRED EMBODIMENTS

Figure 1:
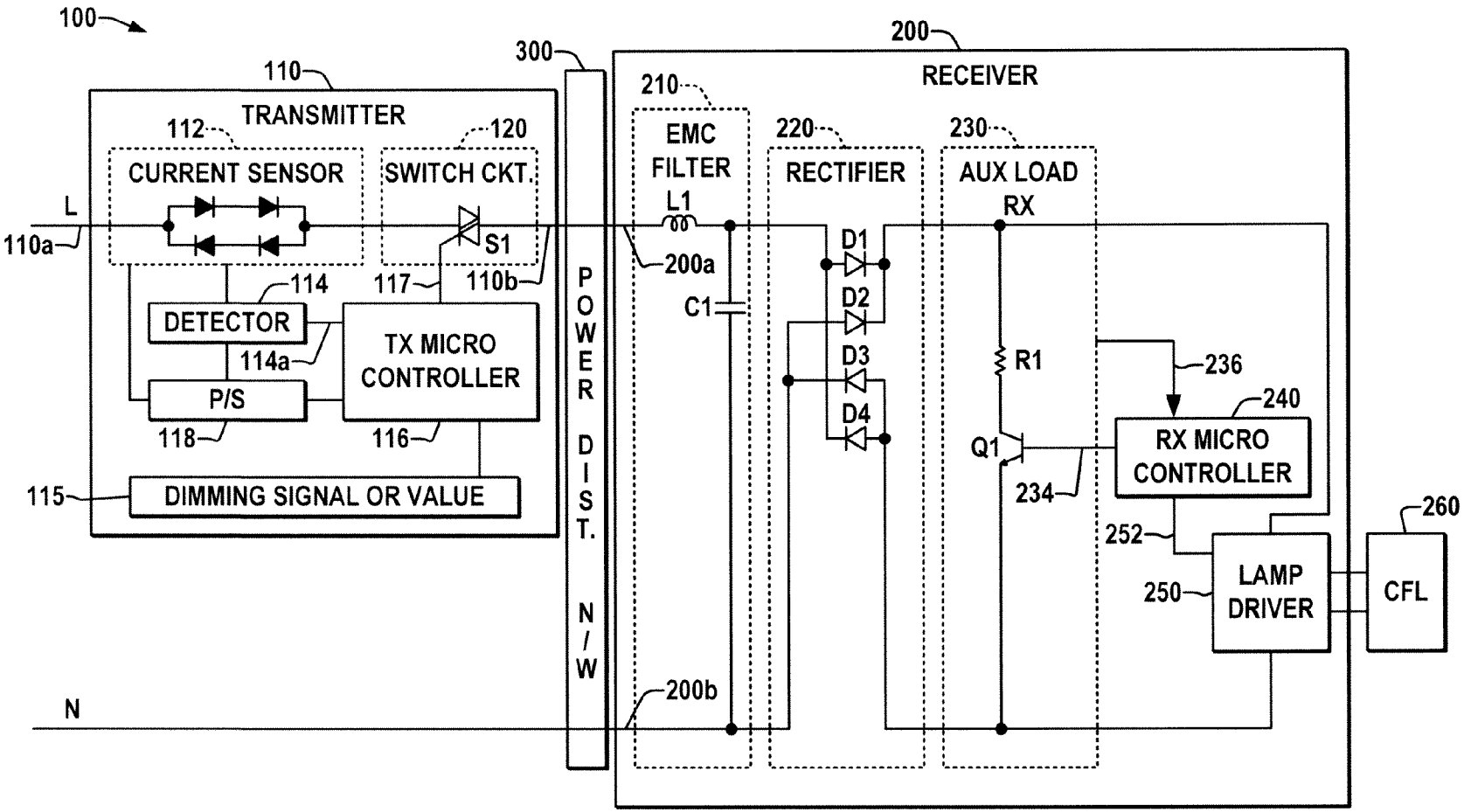
FIG. 1 is a schematic diagram illustrating an exemplary power line communication (PLC) system with a transmitter and receiver connected in series with one another via a power distribution network.

Referring now to the drawings, where like reference numerals are used to refer to like elements throughout, and wherein the various features are not necessarily drawn to scale, FIG. 1 illustrates a power line communication PLC system 100 that includes a transmitter 110 and a receiver 200 connected in series with one another by a power distribution network 300, such as legacy AC power wiring network in one example. The receiver 200 provides power to a compact fluorescent lamp (CFL) 260 via a lamp driver 250 in one example, but other forms of lighting devices may be driven by the receiver 200, including without limitation fluorescent tubes. The transmitter 110 includes an input 110*a* coupleable to a source of AC power, for example, such as a line (L) wire of a typical residential, commercial, industrial AC power wiring implementation, and an output 110*b* coupleable to a power distribution network 300, such as the wiring within walls etc. of the installation between a legacy switch dimmer and a light fixture. The transmitter 110 further includes a sensor circuit 112 that is coupled to sense the current flowing between the input 110*a* and the output 110*b*. A switch circuit 120 is provided in the transmitter 110 in series with the sensor circuit 112 between the input 110*a* and the output 110*b*. The switch circuit 120 is operable according to a switch control signal 117 in a first state to allow current to flow between the input 110*a* and the output 110*b* and a second state to prevent (e.g., interrupt) current from flowing between the input 110*a* and the output 110*b*.

The switch control signal is provided by a transmitter controller 116 that receives one or more user inputs in the form of signals and/or values, such as a dimming signal or value 115. The controller 116 in one embodiment is a processor-based circuit, such as a micro controller, and other embodiments are possible in which the transmitter controller 116 is implemented as hardware, software, logic, or combinations thereof. In operation, the illustrated controller 116 creates multi-bit data and selectively provides the switch control signal 117 to the switch circuit 120 to transmit the data to the power distribution network 300 by selectively interrupting current flow between the input 110*a* and the output 110*b* at least partially according to the user input signal or value 115. In this manner, data representing a desired dimming level is sent via the network 300 to the receiver 200 for use in selective level control of the light generated by the CFL 260.

The exemplary transmitter 110 also includes a detector circuit 114 operative to sense a zero crossing of AC current flowing into the input 110*a*, embodiments of which are illustrated and described in greater detail below with respect to FIGS. 2A and 2B. The detector circuit 114 provides a zero-crossing signal 114*a* to the transmitter controller 116, which provides the switch control signal 117 to the switch circuit 120 to transmit the multi-bit data by selectively interrupting current flow between the input 110*a* and the output 110*b* at a time after receiving the zero-crossing signal 114*a* corresponding to a time when the voltage of the AC power is almost zero. The illustrated transmitter 110 further includes a power supply circuit (P/S) 118 operative to receive power from the sensor circuit 112 and to supply power to the transmitter 110, by which the transmitter 110 is self-powered. The current sensor 112, the detector 114 and the controller 116 in this regard operate to establish the time of the zero-crossing of the AC voltage based on sensed current flow. In one exemplary embodiment, the controller 116 uses the signals 114*a* from the detector 114 to synchronize a free-running oscillator to the current zero-crossings, and once this synchronous state is achieved, data is transmitted in the form of interruptions to the AC current such that the data bits (current interruptions) occur when the voltage of the AC power is almost zero. In certain embodiments, moreover, a semiconductor-based switching circuit 120 is provided for the current interruption data transmission, including a normally closed TRIAC circuit including a TRIAC S1, as exemplified in FIG. 3 below.

As shown in FIG. 1, the receiver 200 is coupled in series with the transmitter 110 via the power distribution network 300. The exemplary receiver includes a first terminal 200*a* coupled to the transmitter output 110*b* via the power distribution network 300 and a second terminal 200*b* coupled to the source of AC power via the network 300. The receiver 200 further includes a rectifier 220 which operates to rectify AC power received from the power distribution network 300 and a driver circuit 250 operable according to a driver control signal 252 to selectively provide electrical power from the rectifier 220 to drive a lighting device 260. The driver 250 can be any circuitry suitable for providing power in a controlled fashion to one or more lighting devices connected thereto, and may include a ballast circuit that in certain embodiments may provide for power factor correction. Certain embodiments of the receiver 200 may also include a filter circuit (e.g., EMC filter) 210 including an inductance L1 and a capacitance C1 coupled between the receiver terminals 200*a*, 200*b* and the rectifier 220.

A load control circuit 230 is provided in the receiver 200, in one embodiment including a resistance R1 in series with a switching device Q1 (e.g., bipolar, MOSFET, or other semiconductor-based switch) which operates to selectively apply an auxiliary load to a load side of the rectifier 220 according to a load control signal 234, as well as to sense current interruptions caused by the transmitter 110 and to provide a data output 236 indicative of the sensed current interruptions. The receiver also includes a receiver controller 240, such as another micro controller that selectively provides the load control signal 234 to load the rectifier output and the controller 240 receives the data output 236 and provide the driver control signal 252 at least partially according to received data from the transmitter 110. The system 100 may be incorporated into a lamp in the given form, or alternatively it may be connected in parallel with the load, thereby enabling the usage of existing electronic ballasts that can receive DSI or 0-10V dimming signals.

Figures 2A, 2B:
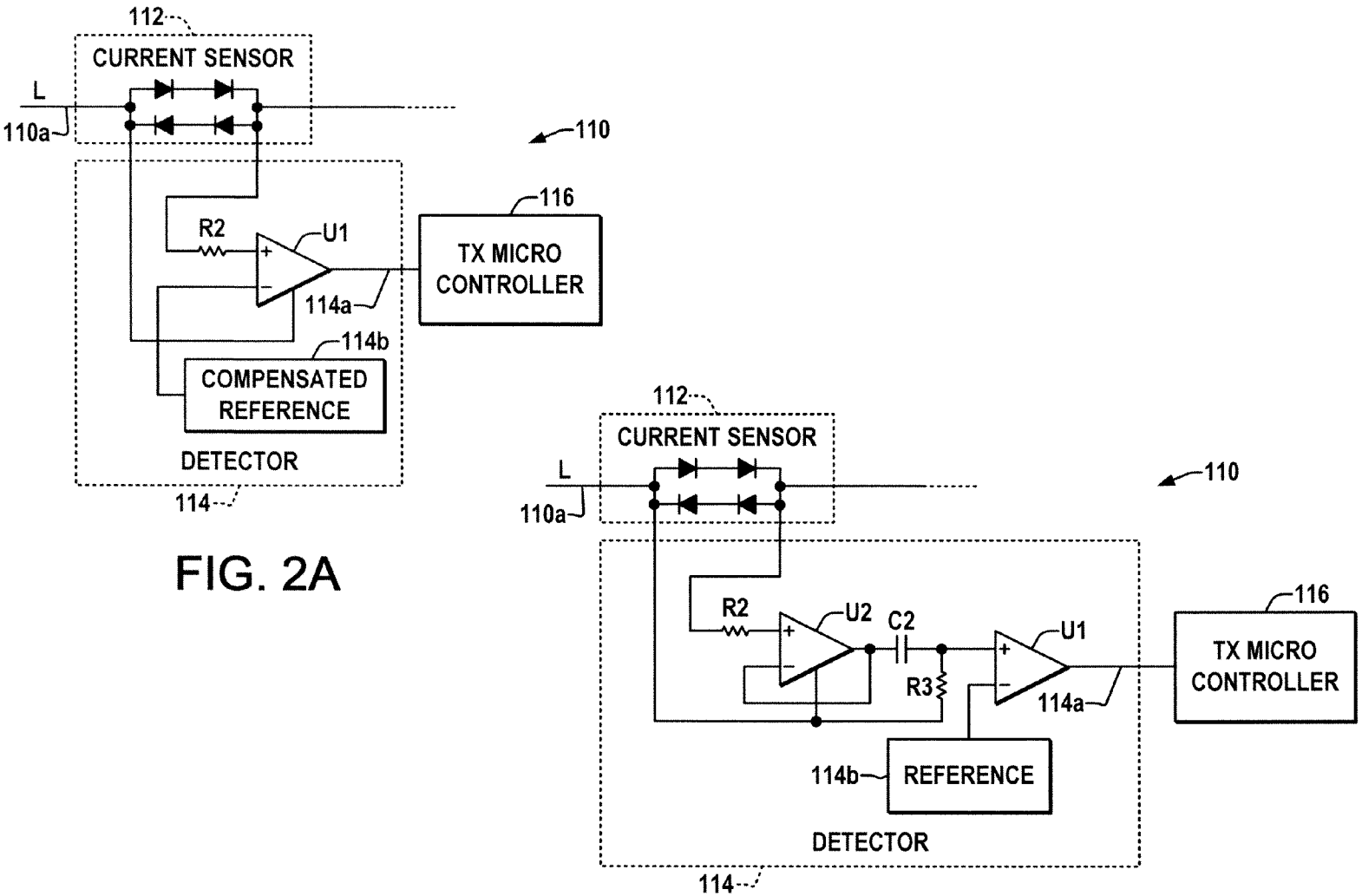
FIGS. 2A and 2B are schematic diagrams illustrating two exemplary embodiments of detector circuits in the transmitter of FIG. 1.

Referring also to FIGS. 2A and 2B, two exemplary embodiments are shown of the detector circuit 114. The current sensor 112 facilitates detection by the controller 116 of zero-crossings on the line, and because of the series configuration of the receiver 200 and transmitter 110, the sensor 112 must pass the full switched line current (e.g., possibly up to 10 A in certain implementations) and also be sensitive enough to detect the zero-crossing when only milliamperes flow. Accordingly, the current sensor circuit 112 in certain embodiments includes a string of anti-parallel diodes since in this case the current-voltage characteristic of the diode are advantageous. In this respect, the voltage drop on an individual diode is limited to around 0.7V, and thus a maximum figure for the power dissipation may be given, and at the same time, when biased with small currents a large dV/dI is provided for sensing the zero-crossing point. The transmitter 110 accounts for two different types of zero crossings. When a resistive load or a load that is equipped with power factor correction (PFC) circuitry is used in the driver circuit 250 of the receiver 200, the current and voltage are essentially in phase and thus only the zero-crossing of the AC current need to be observed. However when a rectifier-capacitor load is presented by the receiver 200 (e.g. possibly with an added EMC filter 210) spurious currents may flow around the zero-crossing, and thus the current-spike that is generated by the auxiliary load needs to be detected.

The voltage output of the current sensor circuit 112 is interpreted by the detector circuit 114. FIG. 2A illustrates a first exemplary embodiment of the circuit 112 including a comparator-based level sensing configuration. This embodiment includes a resistance R2 coupled between an output-side terminal of the sensor circuit 112 and a non-inverting input of a comparator U1, where inverting input of U1 is coupled with a reference 114*b*. The reference 114*b* in this embodiment is temperature compensated for the temperature dependence of the diodes in the current sensor circuit 112, for example, where the compensated reference 114*b* in one embodiment can derive the reference voltage applied to the inverting comparator input from a diode that is placed physically close to the current carrying diodes in the sensor circuit 112 to thereby track their temperature changes.

FIG. 2B shows another possible embodiment of the detector circuit 114 that does not need a temperature compensated reference. This circuit 114 detects zero-crossings using a differentiator configuration of op amp U2, a capacitance C2, and a resistance R3 to detect the edges that occur, which are then compared with a reference 114*b* via a comparator U1. A variant embodiment using this principle can be implemented by performing the differentiator functions in the transmit controller 116 or other digital signal processing component(s) instead of using an RC analog circuit as in FIG. 2B. The illustrated zero crossing detection circuit of FIG. 2B can detect zero crossings to about 100 μs, but use of digital signal processing opens up the possibility of using more advanced techniques.

Figure 3:
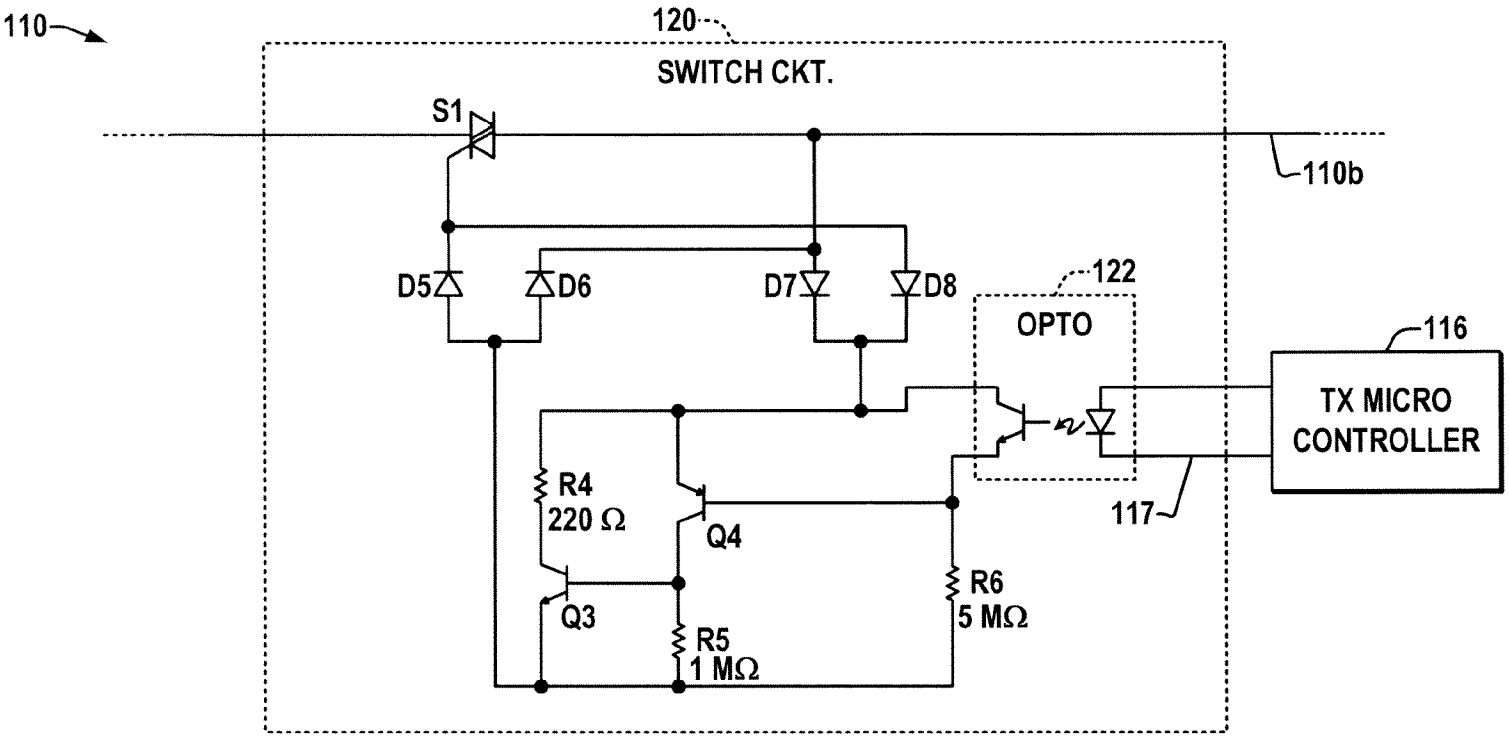
FIG. 3 is a schematic diagram illustrating a normally closed TRIAC circuit used for data transmission by selective current interruption in the transmitter of FIG. 1.

FIG. 3 illustrates an exemplary normally closed TRIAC circuit 120 that may be employed for generating the current interruptions for data transmission by the transmitter 110 of FIG. 1. In this embodiment, a TRIAC S1 is connected in the conduction path of the transmitter 110, and a rectifier circuit formed by diodes D5-D8 is connected between the control terminal (gate) and an MT2 terminal of the TRIAC S1. The rectifier is coupled with a transistor circuit including transistors Q3 and Q4 and resistors R4-R6 which is actuated by an optically coupled switch control signal 117 provided by the transmitter controller 116 to the switch circuit 120 via an opto coupler 122. This exemplary circuit in FIG. 3 advantageously provides a normally closed TRIAC switch S1 that will be in a closed (conducting) state on power up of the transmitter 110. In operation, the transmitter controller 116 provides the switch control signal 117 to interrupt current flow at specific moments when the voltage is low so as to conserve power. The exemplary transmitter 110 is self-powered to avoid problems associated with providing external supply power. Since the transmitter 110 is in series with its load, the exemplary power supply circuit 118 (FIG. 1) obtains transmitter power from rectified voltage established on the current-sensing diodes of circuit 112.

Figure 4:
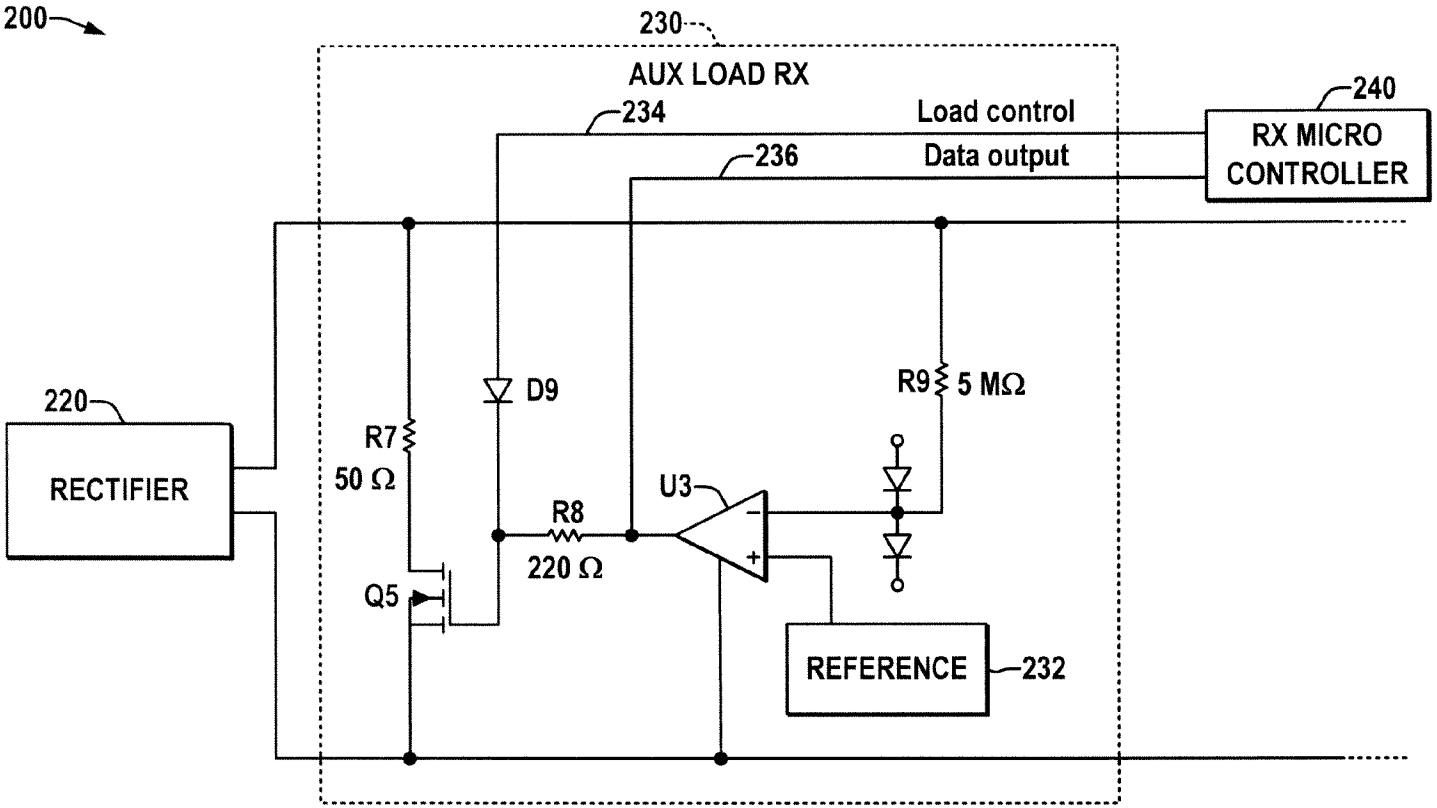
FIG. 4 is a schematic diagram illustrating auxiliary load and circuit in the receiver of FIG. 1.
Figure 5:
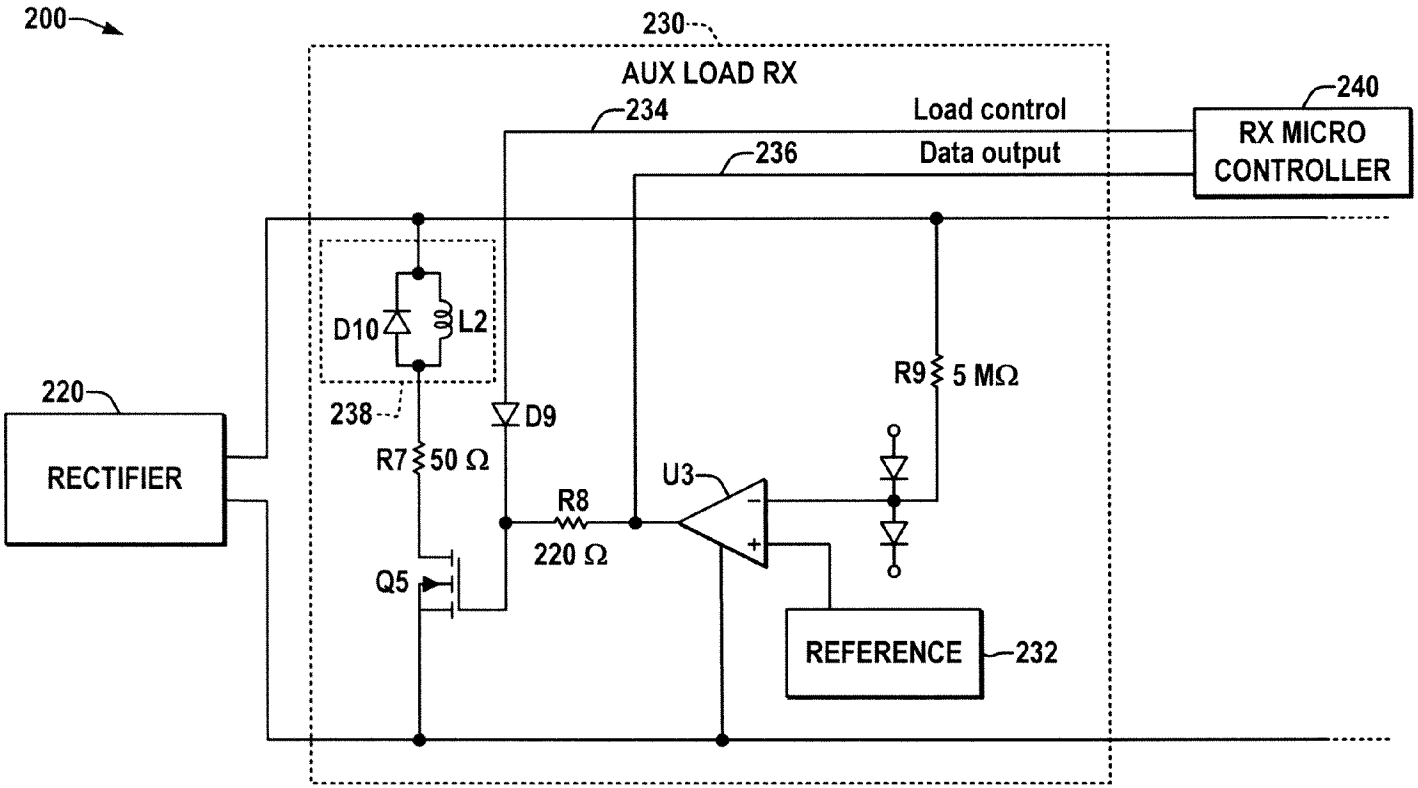
FIG. 5 is a schematic diagram illustrating another embodiment of auxiliary load circuit having a filter for transient current suppression in the receiver of FIG. 1.

Referring now to FIGS. 4 and 5, the auxiliary load circuit 230 of the receiver 200 includes a load resistor R7 in series with a semiconductor-based switch Q5 (a MOSFET in the embodiment of FIG. 4). The circuit 230 also includes circuitry allowing selective switching of the load R7 into the rectifier output circuit by a LOAD CONTROL signal 234 from the receiver controller 240 by controlling the gate of the transistor Q5 via diode D9. The rectifier output voltage is presented to an inverting input of a comparator U3 which compares this with a reference voltage 232 and provides a digital data output signal 236 to the receiver controller 240 that is coupled to the MOSFET gate via a resistor R8. In operation, when the circuit 230 detects an interruption in the current (seen as a drop in the rectifier output), it will turn on the auxiliary load by turning on the MOSFET Q5 so that R7 adds loading to the rectifier output. In the illustrated embodiment, the load resistor R7 will typically only see about 10V in normal operation, and even this is only applied with a very low duty cycle. The load resistor R7 in some embodiments is about 10-100Ω to enable the current of this load resistor R7 to overcome parasitic and second-order effects so that the additional load current is about 0.1-1.0 A. In this embodiment, moreover, the receiver controller 240 drives the switch Q5 so as to enable the auxiliary load when the line voltage is less than a specified value as set by the reference 232. In order to provide fast control of the auxiliary load application, a hardware solution is used in FIG. 4, where the controller 240 may utilize a comparator circuit U3 with a reference voltage 232 of about 2-5V, or alternatively a logic gate (e.g. such as a 74HC04 in one possible alternative embodiment) may be used because it is essentially a very fast comparator with a reference around 1.5-2.5V. Other possible embodiments include a single-transistor discrete circuit.

Referring also to FIG. 5, the auxiliary load circuit 230 may also include a transient suppression filter circuit 238 including an inductance L2 and a diode D10 in series with the loading resistor R7. In transient conditions, such as when the receiver 200 is suddenly unplugged then reconnected, a condition may occur when the switch Q5 controlling the load resistor R7 is in a conductive (closed) state and a large voltage (e.g., possibly 350V) is imposed across the load resistor R7 for the time that it takes the receiver controller 240 to interrupt this current. Using a 74HC04 and a bipolar transistor as the switch Q5 with a hard base drive this time may be on the order of about 10 ns. This transient current pulse subjects both the resistor and the switch transistor to a very large current burst. It is probably not economical to choose a transistor whose safe operating area (SOA) includes such conditions. These transient currents may be attenuated by the filter circuit 238, where one embodiment may provide for implementation of the choke inductance L2 as a wound trace on a printed circuit board. The auxiliary load circuit 230, moreover, provides a separate load control input 234 by which the controller 240 can force the load resistor R7 into the circuit via Q5. By selective use of this loading control, the receiver 200 can be used even in the presence of large EMC-filter capacitors (e.g., in the filter circuit 210). In one embodiment, the receiver controller 240 is operative to synchronize itself to zero-crossings and then to selectively activate the load resistor R7 via signal 234 for a short time in each zero-crossing to dissipate the energy of the EMC filter network 210. Note that after this shunting occurs, the line voltage will drop and the auxiliary load will remain turned on for the duration of the transmission.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated to any component, such as hardware, software, or combinations thereof, which performs the specified function of the described component (i.e., that is functionally equivalent), even though not structurally equivalent to the disclosed structure which performs the function in the illustrated implementations of the disclosure. Although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. However, modifications and alterations will occur to others upon reading and understanding the preceding detailed description. It is intended that the invention be construed as including all such modifications and alterations.

The following is claimed:

1. A power line communication (PLC) system for lighting installations, comprising:

a transmitter comprising:

an input coupleable to a source of AC power, an output coupleable to a power distribution network, a sensor circuit coupled between the input and the output and operative to sense a current flowing between the input and the output, a switch circuit coupled in series with the sensor circuit between the input and the output and operable according to a switch control signal in a first state to allow current to flow between the input and the output and a second state to prevent current from flowing between the input and the output, and a transmitter controller receiving at least one user input signal or value and operative to provide the switch control signal to the switch circuit to transmit data to the power distribution network by selectively interrupting current flow between the input and the output at least partially according to the at least one user input signal or value; and a receiver coupled in series with the transmitter via the power distribution network, the receiver comprising:

a first terminal coupled to the transmitter output via the power distribution network, a second terminal coupled to the source of AC power via the power distribution network, a rectifier operative to rectify AC power received from the power distribution network, a driver circuit operable according to a driver control signal to selectively provide electrical power from the rectifier to drive a lighting device, a load control circuit operative to selectively apply an auxiliary load to a load side of the rectifier according to a load control signal, the load control circuit operative to sense current interruptions caused by the transmitter and to provide a data output indicative of the sensed current interruptions, and a receiver controller operatively coupled with the load control circuit to selectively provide the load control signal to load the rectifier output and operative to receive the data output and provide the driver control signal at least partially according to received data from the transmitter.

2. The PLC system of claim 1, wherein the transmitter controller is operative to provide the switch control signal to the switch circuit to transmit multi-bit data to the transmitter via the power distribution network.

3. The PLC system of claim 2, wherein the transmitter comprises a detector circuit operative to sense a zero crossing of AC current flowing into the input and to provide a zero-crossing signal to the transmitter controller; and wherein the transmitter controller is operative to provide the switch control signal to the switch circuit to transmit the multi-bit data by selectively interrupting current flow between the input and the output at a time after receiving the zero-crossing signal corresponding to a time when the voltage of the AC power is almost zero.

4. The PLC system of claim 3, wherein the transmitter comprises a power supply circuit operative to receive power from the sensor circuit and to supply power to the transmitter.

5. The PLC system of claim 3, wherein the switch circuit is a normally closed TRIAC circuit including a TRIAC.

6. The PLC system of claim 2, wherein the receiver comprises a filter circuit including an inductance and a capacitance coupled between the receiver terminals and the rectifier.

7. The PLC system of claim 2, wherein the transmitter comprises a power supply circuit operative to receive power from the sensor circuit and to supply power to the transmitter.

8. The PLC system of claim 2, wherein the switch circuit is a normally closed TRIAC circuit including a TRIAC.

9. The PLC system of claim 1, wherein the transmitter comprises a detector circuit operative to sense a zero crossing of AC current flowing into the input and to provide a zero-crossing signal to the transmitter controller; and wherein the transmitter controller is operative to provide the switch control signal to the switch circuit to transmit data by selectively interrupting current flow between the input and the output at a time after receiving the zero-crossing signal corresponding to a time when the voltage of the AC power is almost zero.

10. The PLC system of claim 9, wherein the receiver comprises a filter circuit including an inductance and a capacitance coupled between the receiver terminals and the rectifier.

11. The PLC system of claim 9, wherein the transmitter comprises a power supply circuit operative to receive power from the sensor circuit and to supply power to the transmitter.

12. The PLC system of claim 9, wherein the switch circuit is a normally closed TRIAC circuit including a TRIAC.

13. The PLC system of claim 1, wherein the receiver comprises a filter circuit including an inductance and a capacitance coupled between the receiver terminals and the rectifier.

14. The PLC system of claim 1, wherein the transmitter comprises a power supply circuit operative to receive power from the sensor circuit and to supply power to the transmitter.

15. The PLC system of claim 1, wherein the switch circuit is a normally closed TRIAC circuit including a TRIAC.

16. A receiver for operating at least one lighting component in a lighting installation using power line communications (PLC) through a power distribution network, the receiver comprising:

a first terminal coupleable to a PLC transmitter via a power distribution network;

a second terminal coupleable to a source of AC power via the power distribution network;

a rectifier operative to rectify AC power received from the power distribution network;

a driver circuit operable according to a driver control signal to selectively provide electrical power from the rectifier to drive a lighting device;

a load control circuit operative to selectively apply an auxiliary load to a load side of the rectifier according to a load control signal, the load control circuit operative to sense current interruptions caused by the transmitter and to provide a data output indicative of the sensed current interruptions; and a receiver controller operatively coupled with the load control circuit to selectively provide the load control signal to load the rectifier output and operative to receive the data output and provide the driver control signal at least partially according to received data from the transmitter.

* * * * *